US009611853B2

(12) United States Patent
Kanzawa

(10) Patent No.: US 9,611,853 B2
(45) Date of Patent: Apr. 4, 2017

(54) INFORMATION PROCESSING APPARATUS AND IMAGE FORMING APPARATUS

(71) Applicant: Oki Data Corporation, Minatu-ku, Tokyo (JP)

(72) Inventor: Naoki Kanzawa, Tokyo (JP)

(73) Assignee: Oki Data Corporation, Tokyo (JP)

( * ) Notice: Subject to any disclaimer, the term of this patent is extended or adjusted under 35 U.S.C. 154(b) by 1087 days.

(21) Appl. No.: 13/713,082

(22) Filed: Dec. 13, 2012

(65) Prior Publication Data

US 2013/0156551 A1 Jun. 20, 2013

(30) Foreign Application Priority Data

Dec. 16, 2011 (JP) ..... 2011-275481

(51) Int. Cl.

| | |
|---|---|
| ***F04D 29/60*** | (2006.01) |
| ***F04D 25/06*** | (2006.01) |
| ***F04D 3/00*** | (2006.01) |

(52) U.S. Cl.

CPC ..... *F04D 3/00* (2013.01); *F04D 25/0633* (2013.01); *F04D 29/601* (2013.01)

(58) Field of Classification Search

CPC ..... F04D 29/522; F04D 29/602; F05B 2230/604; F05B 2260/30; B41J 29/377; H05K 7/2019

See application file for complete search history.

(56) References Cited

FOREIGN PATENT DOCUMENTS

| | | | |
|---|---|---|---|
| JP | 10161511 A | * | 6/1998 |
| JP | H10-161511 A | | 6/1998 |
| JP | 2006266630 A | * | 10/2006 |
| JP | 2009-265288 A | | 11/2009 |

OTHER PUBLICATIONS

Machine Translation of JP 2006-2666330.*
Machine Translation of JP H10-161511.*

* cited by examiner

*Primary Examiner* — Craig Kim
*Assistant Examiner* — Jason Davis
(74) *Attorney, Agent, or Firm* — Panitch Schwarze Belisario & Nadel LLP

(57) ABSTRACT

An information processing apparatus includes a fan having an impeller. The fan further has a first side and a second side opposite to each other. The information processing apparatus further includes a frame to which the fan is mounted in a predetermined orientation so that the first side of the fan faces the frame. The frame has a ventilation opening facing the impeller. A resilient member is provided on the frame so as to face the fan. The fan has a supporting member on the first side and an opening on the second side. The supporting member faces the resilient member.

15 Claims, 13 Drawing Sheets

INFORMATION PROCESSING APPARATUS AND IMAGE FORMING APPARATUS

BACKGROUND OF THE INVENTION

The present invention relates to an information processing apparatus such as an image forming apparatus having a fan.

There is known an information processing apparatus such as an image forming apparatus having an intake fan or an exhaust fan. See, for example, Japanese Laid-open Patent Publication No. 2009-265288 (FIG. 1 and paragraph 0012).

However, if the exhaust fan is mounted in an opposite orientation during an assembling process of the apparatus, the exhaust fan (intended to exhaust air from the apparatus) may draw air into the apparatus. Similarly, if the intake fan is mounted in the opposite orientation, the intake fan (intended to draw air into the apparatus) may exhaust air from the apparatus.

Therefore, there is a demand for enabling an operator to easily recognize a mounting orientation of the fan after the apparatus is assembled.

SUMMARY OF THE INVENTION

An aspect of the present invention is intended to provide an information processing apparatus and an image forming apparatus enabling an operator to easily recognize a mounting orientation of a fan.

According to an aspect of the present invention, there is provided an information processing apparatus including a fan having an impeller. The fan further has a first side and a second side opposite to each other. The information processing apparatus further includes a frame to which the fan is mounted in a predetermined orientation so that the first side of the fan faces the frame. The frame has a ventilation opening facing the impeller. A resilient member is provided on the frame so as to face the fan. The fan has a supporting member on the first side, and an opening on the second side. The supporting member faces the resilient member.

With such a configuration, it becomes possible for an operator to easily recognize an orientation of the fan mounted in the apparatus.

According to another aspect of the present invention, there is provided an image forming apparatus including a fan having an impeller. The fan further has a first side and a second side opposite to each other. The image forming apparatus further includes a frame to which the fan is mounted in a predetermined orientation so that the first side of the fan faces the frame. The frame has a ventilation opening facing the impeller. A resilient member is provided on the frame so as to face the fan. The fan has a supporting member on the first side, and an opening on the second side. The supporting member faces the resilient member.

Further scope of applicability of the present invention will become apparent from the detailed description given hereinafter. However, it should be understood that the detailed description and specific embodiments, while indicating preferred embodiments of the invention, are given by way of illustration only, since various changes and modifications within the spirit and scope of the invention will become apparent to those skilled in the art from this detailed description.

DETAILED DESCRIPTION OF THE PREFERRED EMBODIMENT

Hereinafter, embodiments of the present invention will be described with reference to drawings. The drawings are provided for illustrative purpose and are not intended to limit the scope of the present invention.

First Embodiment

Figure 1:
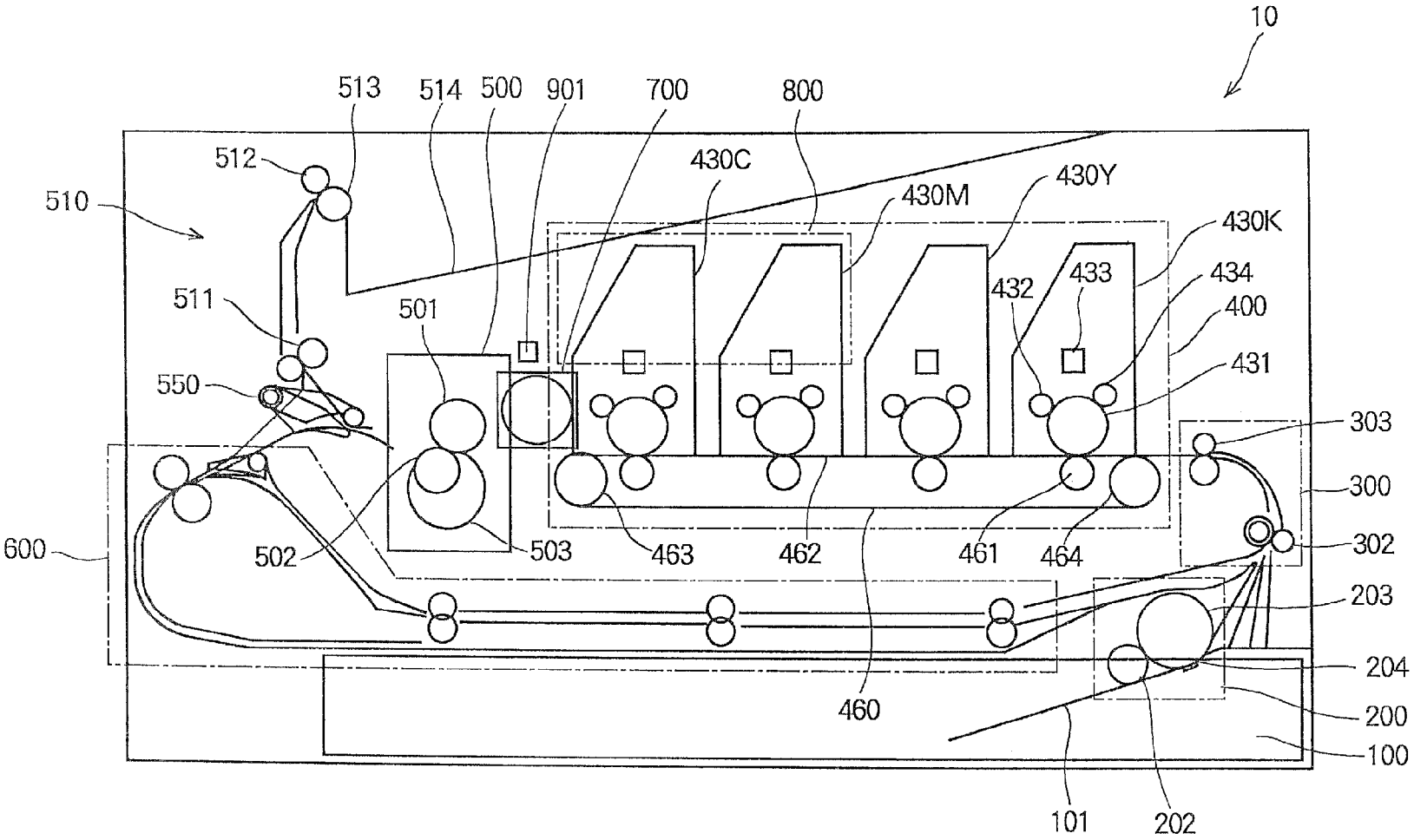
FIG. 1 is a schematic sectional view showing an image forming apparatus as an information processing apparatus according to the first embodiment of the present invention.
Figure 2:
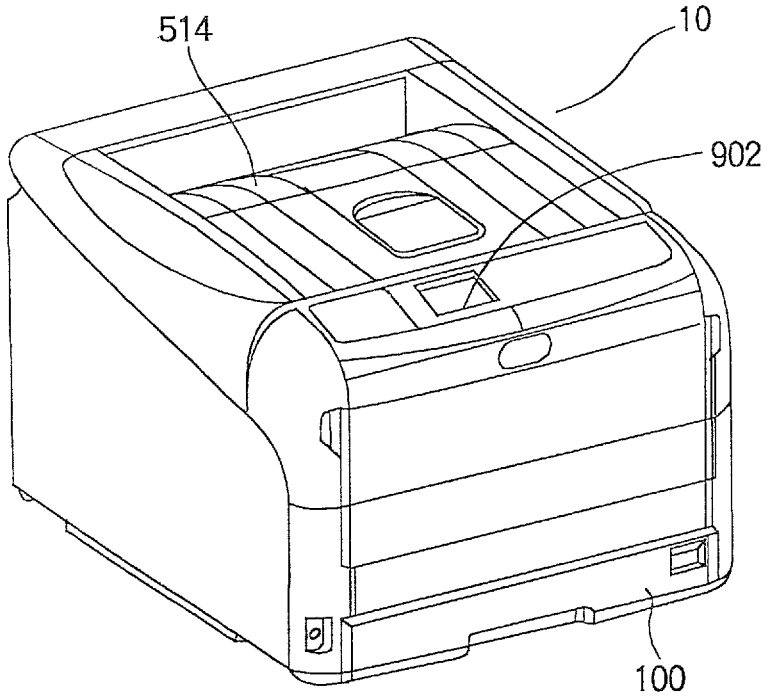
FIG. 2 is a perspective view showing the image forming apparatus according to the first embodiment.

FIGS. 1 and 2 are a schematic sectional view and a perspective view showing an image forming apparatus 10 as an example of an information processing apparatus according to the first embodiment of the present invention. The image forming apparatus 10 shown in FIG. 1 is configured as, for example, a color electrophotographic printer that forms a color image using electrophotographic technology.

The image forming apparatus 10 includes a medium tray 100 in which a stack of sheets (i.e., media) 101 is stored. A medium feeding unit 200 is provided on a medium feeding side (i.e., an upper-right in FIG. 1) of the medium tray 100. The medium feeding unit 200 is configured to feed the sheets 101 one by one out of the medium tray 100. The medium feeding unit 200 includes a pickup roller 202 provided so as to contact the sheet 101 lifted to a predetermined height, and also includes a feed roller 203 and a separation piece 204 for separating the sheets 101 (picked up by the pickup roller 201) into a single sheet 101.

A medium conveying unit 300 is provided on the medium feeding side of the medium feeding unit 200. The medium conveying unit 300 includes conveying roller pairs 302 and 303 that convey the sheet 101 (fed by the medium feeding unit 200) to an image forming portion 400 described below.

The image forming portion 400 includes four toner image forming units (i.e., developer image forming units) 430K, 430Y, 430M and 430C which are linearly arranged in a conveying direction of the sheet 101 (i.e., from right to left in FIG. 1). The image forming portion 400 further includes a transfer unit 460 for transferring toner images formed by the toner image forming units 430K, 430Y, 430M and 430C to the sheet 101.

The toner image forming units 430K, 430Y, 430M and 430C are configured to form toner images (i.e., developer images) of black, yellow, magenta and cyan. The toner image forming units 430K, 430Y, 430M and 430C have the same configuration except the toner, and therefore are collectively referred to as the toner image forming units 430.

The toner image forming unit 430 includes a photosensitive drum 431 as an image bearing body, a charging roller 432 as a charging member for uniformly charging a surface of the photosensitive drum 431, an optical head 433 as an exposure unit for exposing the uniformly-charged surface of the photosensitive drum 431 to form a latent image, and a developing device 434 for developing the latent image on the surface of the photosensitive drum 431 using a toner (i.e., a developer).

The transfer unit 460 includes four transfer rollers 461 as transfer members provided so as to face the photosensitive drums 431 of the respective toner image forming units 430. The transfer unit 460 further includes a transfer belt 462 provided through between the respective photosensitive drums 431 and the transfer rollers 461. The transfer unit 460 further includes a driving roller 463 and a driven roller 464 around which the transfer belt 462 is stretched. The transfer belt 462 is configured to electrostatically hold the sheet 101 at a surface of the transfer belt 462, and moves (rotates) by a rotation of the driving roller 463. The transfer rollers 464 are configured to transfer toner images from the surfaces of the photosensitive drums 431 of the toner image forming units 430 to the sheet 101 on the transfer belt 462 by Coulomb's force.

A fixing unit 500 is provided on a downstream side of the image forming portion 400 (i.e., the toner image forming units 430 and the transfer unit 460) along the conveying direction of the sheet 101. The fixing unit 500 includes, for example, a pressure roller 501, a fixing roller 502 and a fixing belt 503. The fixing unit 500 is configured to apply heat and pressure to the sheet 101 (to which the toner image has been transferred) so as to fix the toner image to the sheet 101.

A separator 550 is provided on the downstream side of the fixing unit 500 along the conveying direction of the sheet 101. The separator 550 is provide for switching between a first conveying path toward an ejection unit 510 and a second conveying path toward a double-sided printing unit 600 described below.

The ejection unit 510 includes ejection roller pairs 511 and 512 that eject the sheet 101 (to which the toner image has been fixed by the fixing unit 500) through an ejection port 513. A stacker portion 514 is provided on an upper part of the image forming apparatus 10. The stacker portion 514 holds the ejected sheets 101 thereon. The double-sided printing unit 600 is configured to invert the sheet 101 to which the toner image has been fixed by the fixing unit 500, and to convey the inverted sheet 101 to the medium conveying unit 300. A detailed description of the double-sided printing unit 600 is omitted.

A fan 700 according to the first embodiment will be described. The fan 700 is provided between the fixing unit 500 as a heat source and the toner image forming unit 430C adjacent to the fixing unit 500. The image forming apparatus 10 further includes an electronic circuit board 800 as a control unit for controlling an operation of the fan 700.

Figure 3C:
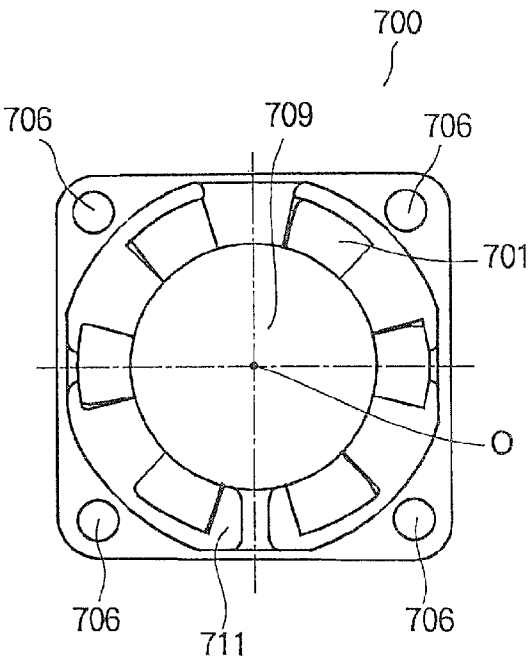
FIGS. 3A, 3B and 3C are respectively a rear view, a sectional view and a front view showing a configuration of a fan according to the first embodiment.
Figure 3B:
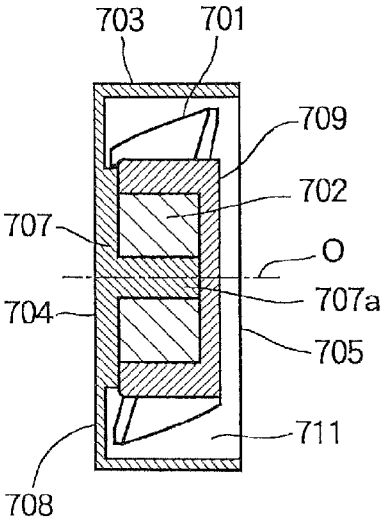
Figure 3A:
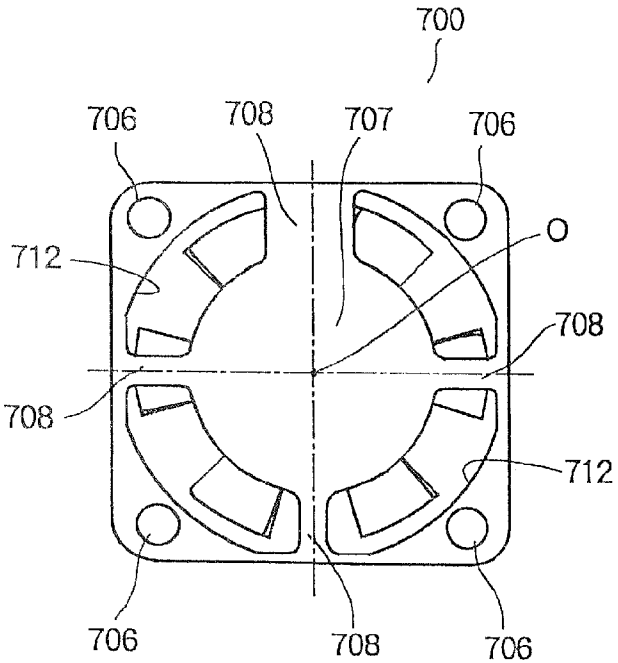

FIGS. 3A, 3B and 3C are respectively a rear view, a sectional view and a front view showing a configuration of the fan 700. The fan 700 includes an impeller 701, a motor 702 for rotating the impeller 701, and a housing 703 that houses the impeller 701 and the motor 702. A rotation axis of the motor 702 (i.e., a rotation axis of the impeller 701) is indicated by a mark "O".

The housing 703 has an exhaust side 704 and an intake side 705 opposite to each other. The exhaust side 704 and the intake side 705 respectively correspond to both sides (i.e., a front side and a rear side) of the housing 703 in an axial direction of the impeller 701. The exhaust side 704 is also referred to as a first side. The intake side 705 is also referred to as a second side. Four mounting holes 706 are provided on four corners of the housing 703. The mounting holes 706 allow screws 2*a* (FIG. 4A) to pass. The screws 2*a* are used to mount the fan 700 to a frame 1 of the image forming apparatus 10.

A fixed shaft 707 is provided at a center portion of the exhaust side 704 of the fan 700. A plurality of (in this example, four) ribs 708 as supporting members are provided on the exhaust side 704 of the fan 700. The ribs 708 are configured to support the fixed shaft 707. The ribs 708 radially extend from the rotation axis O of the impeller 701, and are arranged at 90 degrees about the rotation axis O.

Exhaust openings 712 are formed on the exhaust side 704 of the fan 700. Each exhaust opening 712 is provided between the adjacent two ribs 708, and has an arcuate shape whose center coincides with the rotation axis O. The four mounting holes 706 are respectively shifted relative to the ribs 708 by 45 degrees in a rotational direction (i.e., a circumferential direction) about the rotation axis O.

The fixed shaft 707 has a shaft portion 707*a* that defines a rotation axis of the motor 702. The motor 702 is rotatably mounted to the shaft portion 707*a*. A rotary shaft 709 is provided on an outer circumference of the motor 702. The above described impeller 701 is provided on an outer circumference of the rotary shaft 709.

Figure 4B:
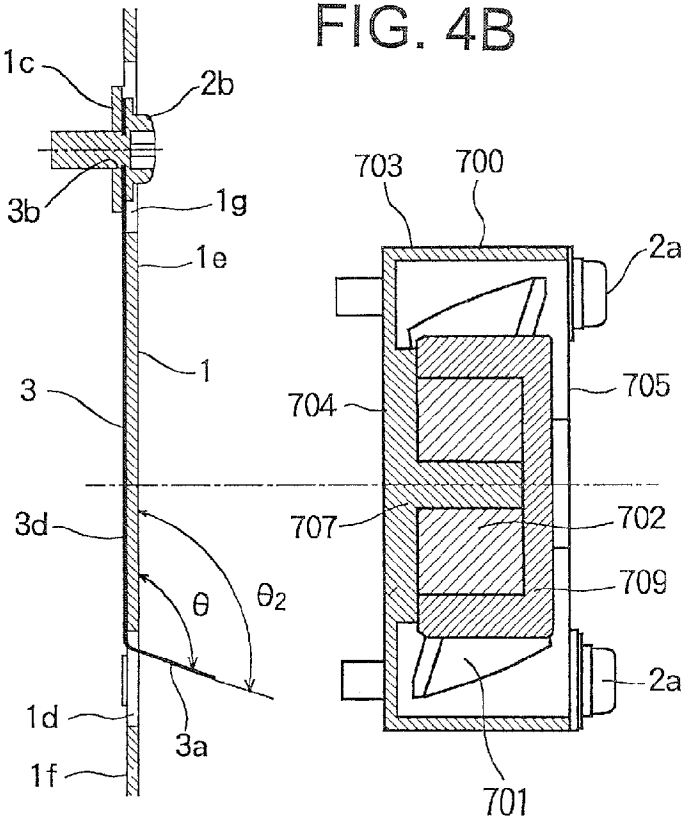
FIGS. 4A and 4B are respectively an exploded perspective view and a sectional view showing a configuration of the fan and a frame according to the first embodiment.
Figure 4C:
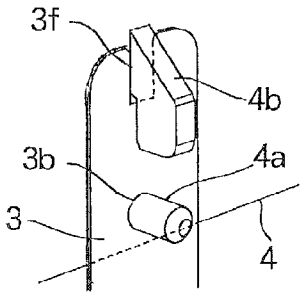
FIG. 4C is a perspective view showing another example of a mounting structure of the fan according to the first embodiment.
Figure 4A:
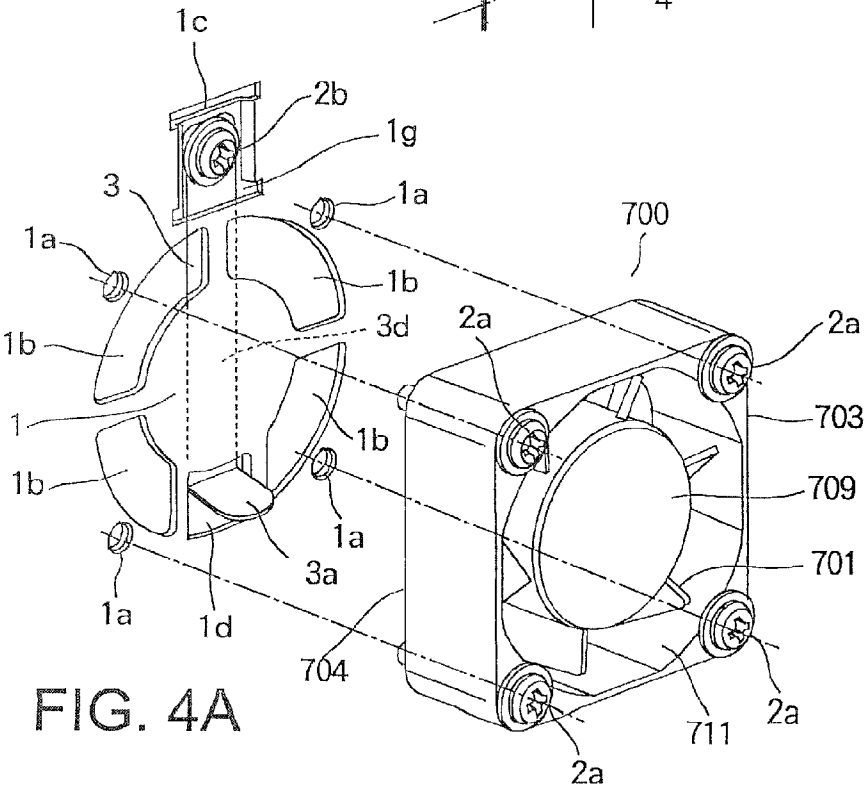

FIGS. 4A and 4B are respectively an exploded perspective view and a sectional view showing a configuration of the fan 700 and the frame 1. As shown in FIGS. 4A and 4B, the fan 700 is mounted to the frame 1. The frame 1 is a formed of a sheet metal, and is provided on a main body of the image forming apparatus 10. As shown in FIG. 4B, the frame 1 (i.e., a fan-fixing portion) has a fan-fixing surface 1*e* to which the fan 700 is fixed, and a back surface 1*f* opposite to the fan-fixing surface 1*e*.

The frame 1 further has internal threads (i.e., female threaded portions) 1*a* corresponding to the four corners of the fan 700. The screws 2*a* are inserted through the mounting holes 706 (FIG. 3C) on the four corners of the fan 700, and screwed into the internal threads 1*a* of the frame, so that the fan 700 is fixed to the frame 700.

The frame 1 has ventilation openings (or exhaust openings) 1*b* that allows passage of air exhausted by the fan 700. A plurality of (in this example, four) ventilation openings 1*b* are formed on the frame 1. Each ventilation opening 1*b* has an arcuate shape along the rotational direction of the impeller 701. In this regard, the ventilation opening 1*b* can be in the form of a circular hole, a slit or the like.

As shown in FIG. 4B, the film 3 (i.e., a film member) as a resilient member is mounted to the back surface 1*f* of the frame 1. The film 3 is formed of, for example, a resilient material such as rubber, resin or the like. The film 3 has a base portion 3*d* having an elongated shape, and a bent portion 3*a* formed at an end (in this example, a lower end) of the base portion 3*d*. The bent portion 3*a* is bent toward the fan 700.

An angle θ between the bent portion 3*a* and the base portion 3*d* of the film 3 is an obtuse angle. An angle θ2 between the bent portion 3*a* of the film 3 and the frame 1 is also an obtuse angle.

Figure 7A:
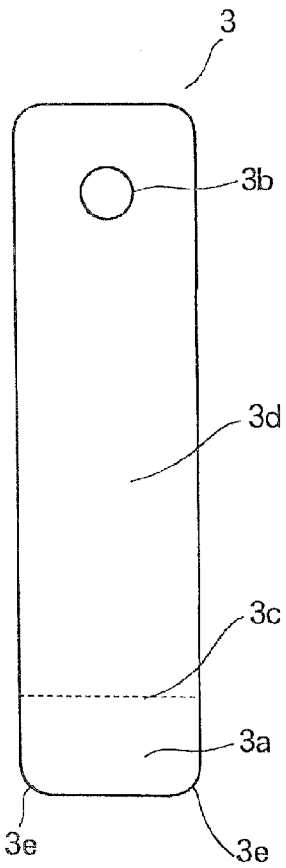
FIGS. 7A and 7B are plan views respectively showing a film according to the first embodiment and a modification of the film according to the first embodiment.

The film 3 is fixed to the frame 1 in such a manner that a longitudinal direction of the film 3 is aligned with a vertical direction. A fixing hole 3*b* (i.e., a through hole) is formed in the vicinity of an end (in this example, an upper end) of the base portion 3*d* of the film 3 opposite to the end (i.e., the lower end) where the bent portion 3*a* is formed. A ridge line 3*c* (FIG. 7A) is defined between the bent portion 3*a* and the base portion 3*d*. Corners of a tip of the bent portion 3*a* are rounded, which are referred to as rounded portions 3*e* (FIG. 7A).

A mounting portion 1*c* (FIG. 4A) having an embossed shape is formed on the back surface 1*f* side of the frame 1. The mounting portion 1*c* is located above a mounting position of the fan 700. The end (i.e., the upper end) of the film 3 where the fixing hole 3*b* is formed is fixed to the mounting part 1*c*.

More specifically, a screw 2*b* is inserted through the fixing hole 3*b* of the film 3, and is screwed into an internal thread formed on the mounting portion 1*c*, so that the film 3 is fixed to the frame 1. The frame 1 has an opening 1*g* that allows the screw 2*b* to pass when the film 3 is fixed to the mounting part 1*c*.

With such a configuration, the film 3 functions as a cantilever having an fixed end portion on the fixing hole 3*b* side, and a free end portion on the bent portion 3*a* side.

The frame 1 has an opening 1*d* through which the bent portion 3*a* of the film 3 protrudes toward the fan-fixing surface 1*e* side. In a state where the fan 700 is mounted to the frame 1 in a correct orientation (i.e., in a state where the exhaust side 704 of the fan 700 is fixed to the fan-fixing surface 1*e*), the bent portion 3*a* of the film 3 contacts the rib 708 of the exhaust side 704 of the fan 700. Therefore, the bent portion 3*a* of the film 3 does not enter inside the fan 700.

In contrast, in a state where the fan 700 is mounted to the frame in an opposite orientation (i.e., in a state where the intake side 705 of the fan 700 is fixed to the fan-fixing surface 1*e*), the bent portion 3*a* of the film 3 enters inside the fan 700 through the opening 711 of the intake side 705 of the fan 700. Detailed description will be made later.

In the example shown in FIGS. 4A and 4B, the film 3 is mounted to the frame 1 using the screw 2*b*. However, a mounting structure of the film 3 is not limited to this example. For example, it is also possible to employ a mounting structure shown in FIG. 4C.

In the mounting structure of FIG. 4C, a resin member 4 with a post 4*a* and an engaging portion (i.e., a craw portion 4*b*) are preliminarily formed is mounted to the frame 1. A hole portion 3*b* and a to-be-engaged portion (for example, a notch) 3*f* are formed on the film 3. The post 4*a* of the resin member 4 engages the hole portion 3*b* of the film 3, and the engaging portion 4*b* of the resin member 4 engages the to-be-engaged portion 3*f*, so that the film 3 is positioned relative to and fixed to the frame 1.

A function of the film 3 will be described.

Figure 5B:
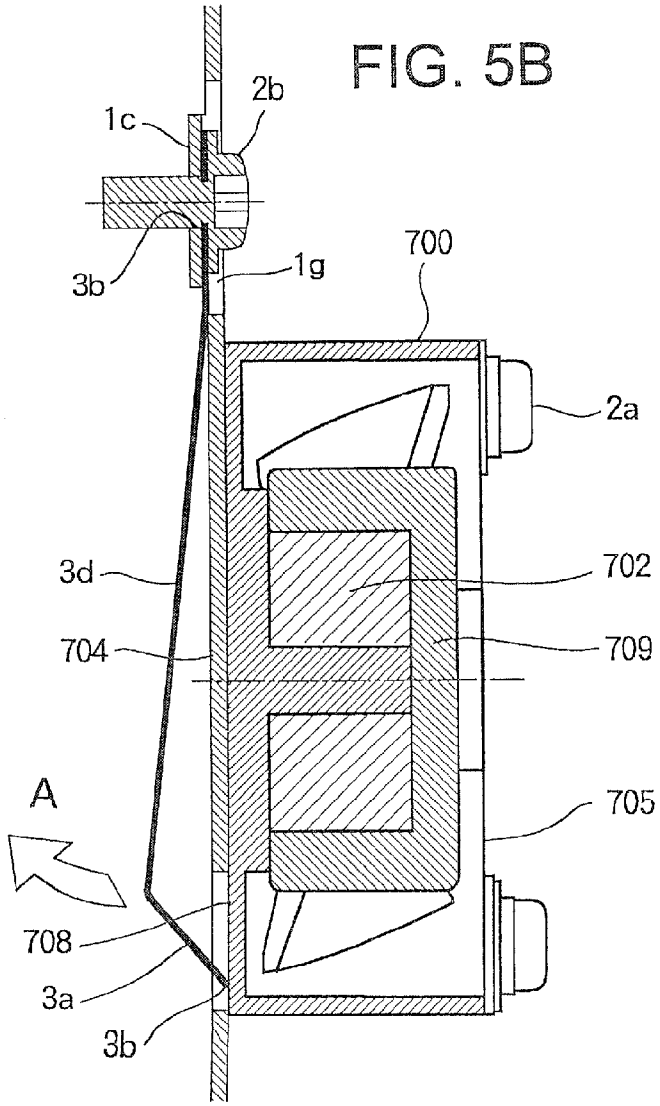
FIGS. 5A and 5B are respectively a perspective view and a sectional view showing a state where the fan is mounted to the frame in a correct orientation according to the first embodiment.
Figure 5A:
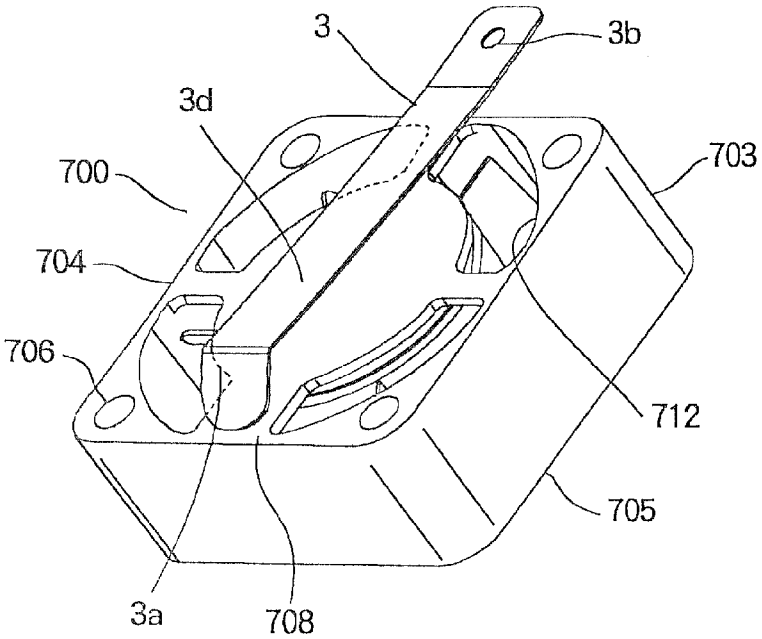

FIGS. 5A and 5B are respectively a perspective view and a sectional view showing a state where the fan 700 is mounted to the frame 1 in the correct orientation. The frame 1 is omitted in FIG. 5A. When the fan 700 is mounted to the frame in the correct orientation, the bent portion 3*a* of the film 3 faces the rib 708 (i.e., the supporting member) of the fan 700. Therefore, the bent portion 3*a* of the film 3 contacts the rib 708 of the fan, and the film 3 deforms so that the bent portion 3*a* is pushed outward via the opening 1*d* of the frame 1 as shown in FIG. 5B. Accordingly, the bent portion 3*a* of the film 3 does not interfere with the impeller 701 of the fan 700.

Figure 6C:
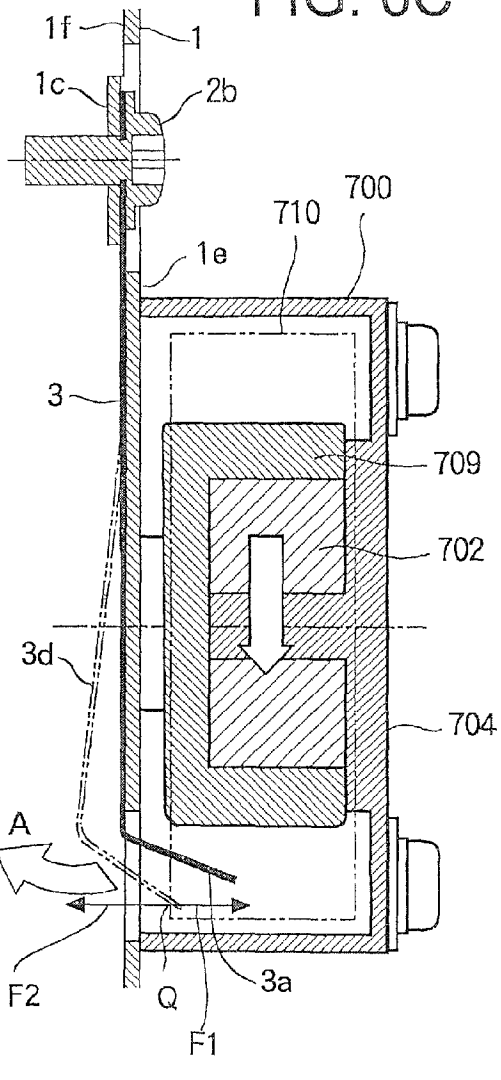
FIG. 6C is a sectional view showing a state where an impeller of the fan rotates when the fan is mounted to the frame in the opposite orientation according to the first embodiment.
Figure 6B:
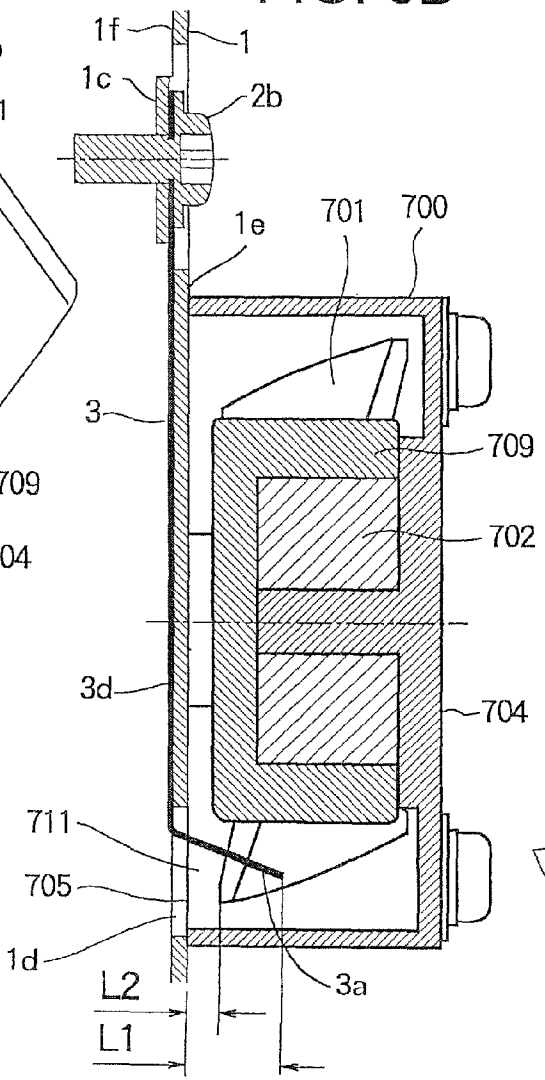
FIGS. 6A and 6B are respectively a perspective view and a sectional view showing a state where the fan is mounted to the frame in an opposite orientation according to the first embodiment.
Figure 6A:
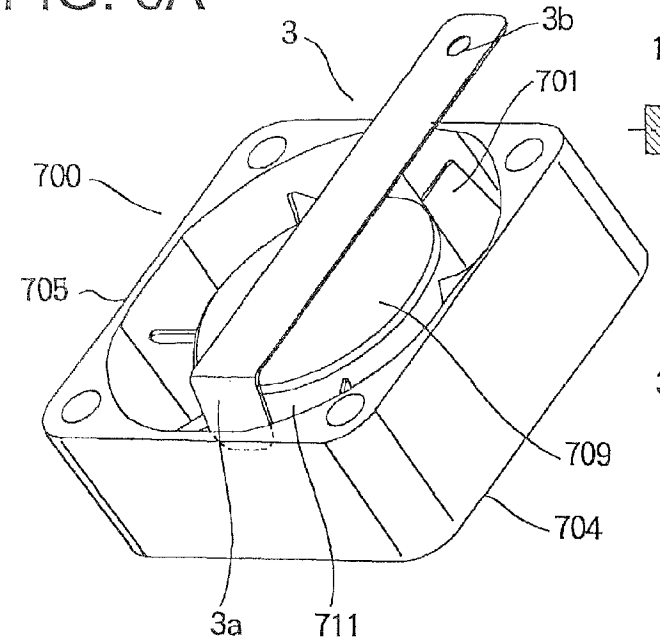

FIGS. 6A and 6B are respectively a perspective view and a sectional view showing a state where the fan 700 is mounted to the frame 1 in the opposite orientation. The frame 1 is omitted in FIG. 6A. When the fan 700 is mounted to the frame 1 in the opposite orientation (i.e., when the intake side 705 of the fan 700 is fixed to the fan-fixing surface 1*e*), the bent portion 3*a* of the film 3 enters inside the fan 700 via the opening 711 formed on the intake side 705 of the fan 700.

The bent portion 3*a* of the film 3 entering inside the fan 700 reaches a rotational area 710 of the impeller 701 of the fan 700. In this regard, the rotational area 710 is an area where at least a part of the impeller 701 passes when the fan 700 rotates the impeller 701.

In FIG. 6B, a distance from the intake side 705 of the fan 700 (fixed to the fan-fixing surface 1*e* when the fan 700 is mounted in the opposite orientation) to the tip of the bent portion 3*a* of the film 3 is expressed as L1. A distance from the intake side 705 to the impeller 701 is expressed as L2. In FIG. 6B, the distances L1 and L2 satisfy the relationship L1>L2, which means that the bent portion 3*a* of the film 3 reaches the rotational area 710 of the impeller 701.

If the motor 702 is driven to rotates in this state, the impeller 701 flips up the bent portion 3*a* of the film 3 to cause the bent portion 3*a* to deform in the direction indicated by the arrow A, and generates a noise. Thanks to the noise, an operator can recognize that the fan 700 is mounted to the frame 1 in the opposite orientation (i.e., the fan 700 is mounted to the frame 1 in such a manner that the intake side 705 of the fan 700 faces the frame 1).

As shown in FIG. 6C, in the rotational area 710 of the impeller 701, a contact point where the bent portion 3*a* contacts the impeller 701 is expressed as Q. Further, a counterforce with which the bent portion 3*a* pushes the impeller 701 at the contact point Q is expressed as F1. A force with which the impeller 701 (driven by the motor 702) pushes up the film 3 at the contact point Q is expressed as F2. The forces F1 and F2 satisfy the relationship F1<F2. In other words, the bent portion 3*a* of the film 3 pushes the impeller 701 with a relatively small force so as not to stop the rotation of the impeller 701, and the bent portion 3*a* of the film 3 is flipped up by the rotating impeller 701.

The bent portion 3*a* flipped up by the impeller 701 repeatedly contacts the impeller 701 to generate a noise. This noise informs the operator of that the fan 700 is mounted to the frame 1 in the opposite orientation.

Figure 7B:
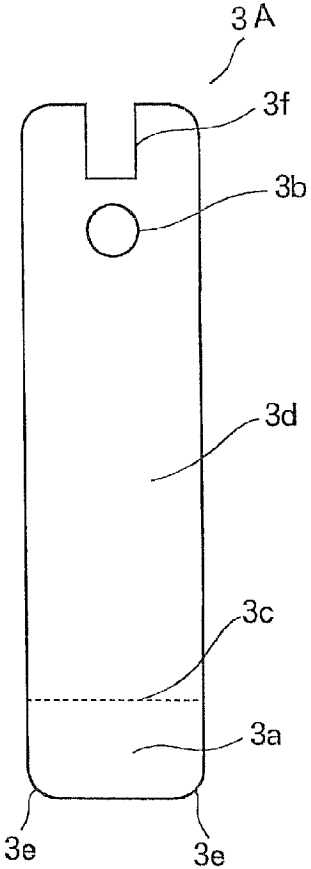
Figure 7C:
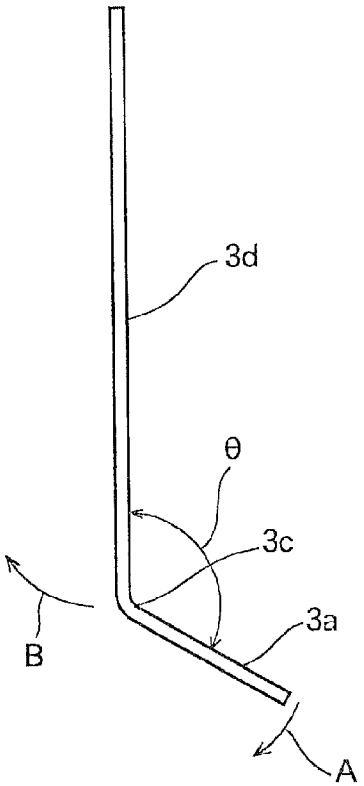
FIGS. 7C and 7D are side views respectively showing the film according to the first embodiment and a film of comparison example.

Here, a bent angle of the bent portion 3*a* of the film 3 will be described. FIG. 7A is a plan view showing a shape of the film 3. FIG. 7B is a plan view showing a shape of the film 3 (referred to as a film 3A) employing the mounting structure shown in FIG. 4C. FIG. 7C is a side view showing the film 3.

In FIG. 7C, the bent portion 3*a* of the film 3 is formed so that the angle θ between the bent portion 3*a* and the base portion 3*d* is an obtuse angle. With such a configuration, when the bent portion 3*a* of the film 3 contacts the impeller 701, the bent portion 3*a* of the film 3 is pushed by the impeller 701 in a direction A away from the impeller 701, i.e., in a direction in which the angle θ increases. In this state, the base portion 3*d* of the film 3 is applied with a force at a point in the vicinity of the ridge line 3*c*, and is pushed in a direction B away from the impeller 701.

Therefore, when the bent portion 3*a* of the film 3 starts contacting the impeller 701, a counterforce applied to the impeller 701 by the film 3 in a direction to resist the rotation of the impeller 701 (a force with which the bent portion 3*a* of the film 3 pushes the impeller 701) is small. The counterforce of the film 3 gradually increases as the film 3 deforms in the direction away from the impeller 701. Therefore, a load applied to the fan 700 due to the contact between the impeller 701 and the bent portion 3*a* of the fin 3 can be reduced.

In other words, even when the impeller 701 rotates in a state where the fan 700 is mounted to the frame 1 in the opposite orientation, it becomes possible to prevent the impeller 701 and the film 3 from being damaged.

Figure 7D:
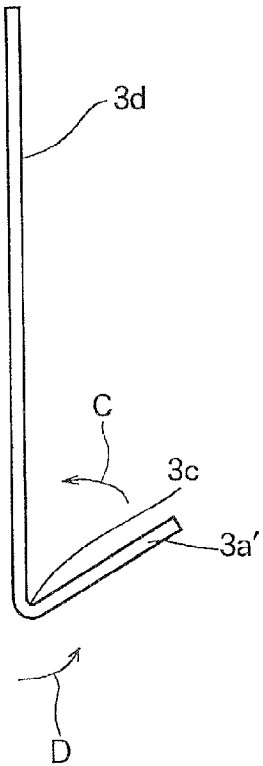

In contrast, if the bent portion 3*a*' of the film 3 is formed so that the angle θ between the bent portion 3*a*' and the base portion 3*d* is an acute angle as shown in FIG. 7D, the bent portion 3*a*' of the film 3 is pushed in a direction C (i.e., in a direction in which the angle θ decreases) when the impeller 701 contacts the bent portion 3*a*' of the film 3. In this state, the base portion 3*d* of the film 3 is applied with a force (at a point in the vicinity of the ridge line 3*c*) in a direction D toward the impeller 701. Therefore, the above described effect of flipping up the film 3 without applying a large load to the fan 700 may not be sufficiently achieved.

Further, when the angle θ between the bent portion 3*a* and the base portion 3*d* is a right angle (90 degrees), it is uncertain whether the film 3 takes the form shown in FIG. 7C or the form shown in FIG. 7D. For these reasons, it is preferable that the angle θ between the bent portion 3*a* and the base portion 3*d* is an obtuse angle.

A rotation speed of the impeller 701 is reduced by application of the counterforce when the impeller 701 contacts the bent portion 3*a* of the film 3. Therefore, the image forming apparatus 10 has a sensor 901 (FIG. 1) as a detection unit for detecting a rotational condition of the impeller 701. More specifically, the sensor 901 detects a rotation number (or a rotation speed) of the impeller 701. The control unit (i.e., the electronic circuit board) 800 detects a decrease in the rotation number based on a detection result of the sensor 901.

In a particular example, the control unit 800 compares the rotation number of the impeller 701 detected by the sensor 901 and a reference rotation number. The control unit 800 determines that the rotation number of the impeller 701 decreases when a difference between the detected rotation number and the reference rotation number exceeds a predetermined value.

When the control unit 800 determines that the rotation number of the impeller 701 decreases, the control unit 800 causes a display unit 902 (FIG. 2) of the image forming apparatus 10 to display a message to draw attention of an operator. The message indicates that the rotation of the fan 700 is abnormal, or indicates that the rotation number of the fan 700 decreases. In other words, the display unit 902 displays information on the condition of the fan 700.

Further, in FIG. 4A, a sufficient distance is provided between the fixing hole 3*b* and the bent portion 3*a* of the film 3. This is achieved by forming the opening 1*d* (allowing passage of the bent portion 3*a*) on the opposite side to the mounting portion 1*c* relative to the rotation axis O of the motor 702. Since the sufficient distance is provided between the fixing hole 3*b* and the bent portion 3*a* of the film 3, the film 3 can easily deform when the bent portion 3*a* contacts the impeller 701. Therefore, a load applied to the fan 700 can be reduced. That is, even when the fan 700 is mounted to the frame 1 in the opposite orientation, the fan 700 can be prevented from being overloaded. Accordingly, a malfunction of the fan 700 can be prevented.

A material of the film 3 is not limited to the above described rubber, resin and the like. It is only necessary that the film 3 achieves the function described with reference to FIGS. 6A through 6C using resiliency. For example, the film 3 can be made of a combination of two resilient materials.

Next, an operation of the image forming apparatus 10 will be described.

When an image forming operation is started, the sheets 101 stored in the medium tray 100 are picked up by the pickup roller 202, and separated into a single sheet 101 by the feed roller 203 and the separation piece 204. The sheet 101 is conveyed by the conveying roller pairs 302 and 303 to the image forming portion 400.

In the image forming portion 400, the sheet 101 is held by the transfer belt 462, and passes the toner image forming units 430K, 430Y, 430M and 430C. In each of the image forming units 430K, 430Y, 430M and 430C, the surface of the photosensitive drum 431 is exposed with light emitted by the optical head 433, and a latent image is formed on the surface of the photosensitive drum 431. The latent image is developed by the developing device 434, and a toner image (i.e., a developer image) is formed on the surface of the photosensitive drum 431. The toner image is transferred from the photosensitive drum 431 to the sheet 101 by the transfer portion 460.

The toner images of the respective colors are transferred from the photosensitive drums 431 of the toner image forming units 430K, 430Y, 430M and 430C to the sheet 101. Then, the sheet 101 is conveyed to the fixing unit 500. The fixing unit 500 applies heat and pressure to the sheet 101, and the toner image is fixed to the sheet 101. The sheet 101 to which the toner image is fixed is conveyed by the ejection roller pairs 511 and 512, and is ejected via the ejection port 513. The ejected sheet 101 is placed on the stacker portion 514. With this, the image forming operation is completed.

During the operation of the image forming apparatus 10, the fan 700 is driven by electricity supplied by a not shown power source. The impeller 701 rotates is driven by the motor 702 (FIGS. 3A through 3C) to rotate about the rotation axis O. When the impeller 701 rotates, air having been heated inside the image forming apparatus 10 (particularly, heated around the fixing unit 500) flows into the fan 700 through the intake side 705, and is exhausted from the fan 700 through the exhaust opening 712. The air exhausted through the exhaust opening 712 of the fan 700 is exhausted outside the image forming apparatus 10 through the ventilation opening 1*b* (FIG. 4A) of the frame 1. With such a configuration, an interior of the image forming apparatus 10 is cooled.

In this regard, if the fan 700 is mounted to the frame 1 in the opposite orientation in an assembling process of the image forming apparatus 10, such an incorrect mounting can be detected during a test operation before the image forming apparatus 10 is shipped. That is, when the motor 702 of the fan 700 starts rotation, the impeller 701 flips up the bent portion 3*a* of the film 3 to generate a noise as described above. Thanks to the noise, the operator can recognize that the fan 700 is mounted to the frame 1 in the opposite orientation. The operator can dismount the incorrectly mounted fan 700 from the frame 1, and then mount the fan 700 to the frame 1 in the correct orientation.

As described above, according to the first embodiment of the present invention, when the fan 700 is mounted to the frame 1 in the opposite orientation, the operator can recognize the improper mounting of the fan 700 based on the noise caused by contact between the impeller 701 of the fan 700 and the film 3. Accordingly, it becomes possible for the operator to dismount the incorrectly mounted fan 700 from the frame 1 and mount the fan 700 to the frame 1 in the correct orientation.

Further, since the bent portion 3*a* of the film 3 interferes with the rotation of the impeller 701 of the fan 700 only when the fan 700 is mounted to the frame 1 in the opposite orientation, the bent portion 3*a* of the film 3 does not interfere with the rotation of the impeller 701 of the fan 700 when the fan 700 is mounted to the frame 1 in the correct orientation.

Furthermore, since the angle θ between the bent portion 3*a* and the base portion 3*d* of the film 3 is an obtuse angle, a rotational load applied to the fan 700 due to the contact between the impeller 701 and the bent portion 3*a* of the film 3 can be reduced.

Moreover, the film 3 is made of a resilient member. In the longitudinal direction of the film 3, an end portion (i.e., the fixing hole 3*b*) of the film 3 is fixed to the frame 1, and the bent portion 3*a* is formed on the other end portion of the film 3. Therefore, the film 3 can easily deform when the impeller 701 contacts the bent portion 3*a* of the film 3. Accordingly, a rotational load applied to the fan 700 can be further reduced.

In this embodiment, the force F1 (FIG. 6C) with which the film 3 pushes the impeller 701 is smaller than the force F2 with which the impeller 701 pushes up the film 3 (F1<F2). However, this embodiment is not limited to such a configuration, but the force F1 can be larger than the force F2 (F1>F2). In this case, the rotation of the impeller 701 is stopped by the contact between the bent portion 3*a* of the film 3 and the impeller 701. Therefore, it is possible that the electronic circuit board (i.e., the control unit) 800 detects the stopping of the rotation of the impeller 701 using, for example, the sensor 901, and causes to display unit 902 to a massage or the like to draw attention of the operator.

Figure 8:
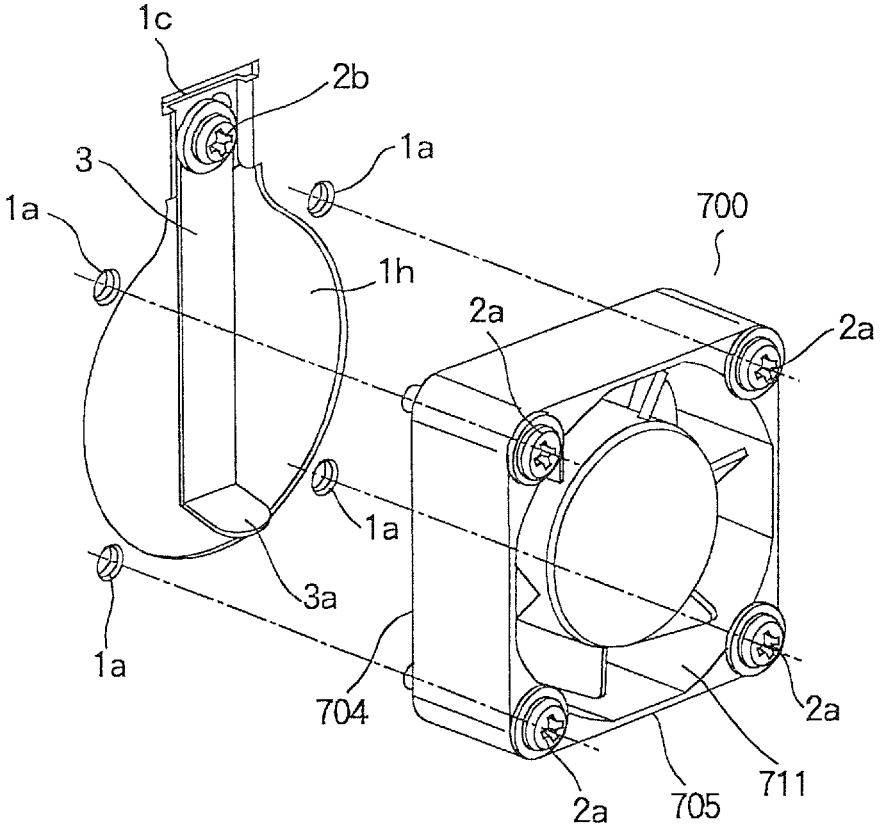
FIG. 8 is a perspective view showing a modification of the mounting structure of the film according to the first embodiment.

Further, in this embodiment, the base portion 3*d* of the film 3 is fixed to the back surface 1*f* of the frame 1 which is opposite to the fan-fixing surface 1*e*, and the angle θ2 (FIG. 4B) between the bent portion 3*a* and the fan-fixing surface 1*e* is an obtuse angle. However, it is only necessary that the film 3 functions as a cantilever having a fixed end portion (i.e., the fixing hole 3*b* side) and a free end portion (i.e., the bent portion 3*a* side). For example, as shown in FIG. 8, the frame 1 can have a single large opening 1*h* having a size encompassing the exhaust openings 1*b* and the opening 1*d* (FIG. 4A). In such a case, the film 3 can be provided so as to extend in the opening 1*h*.

Figure 9:
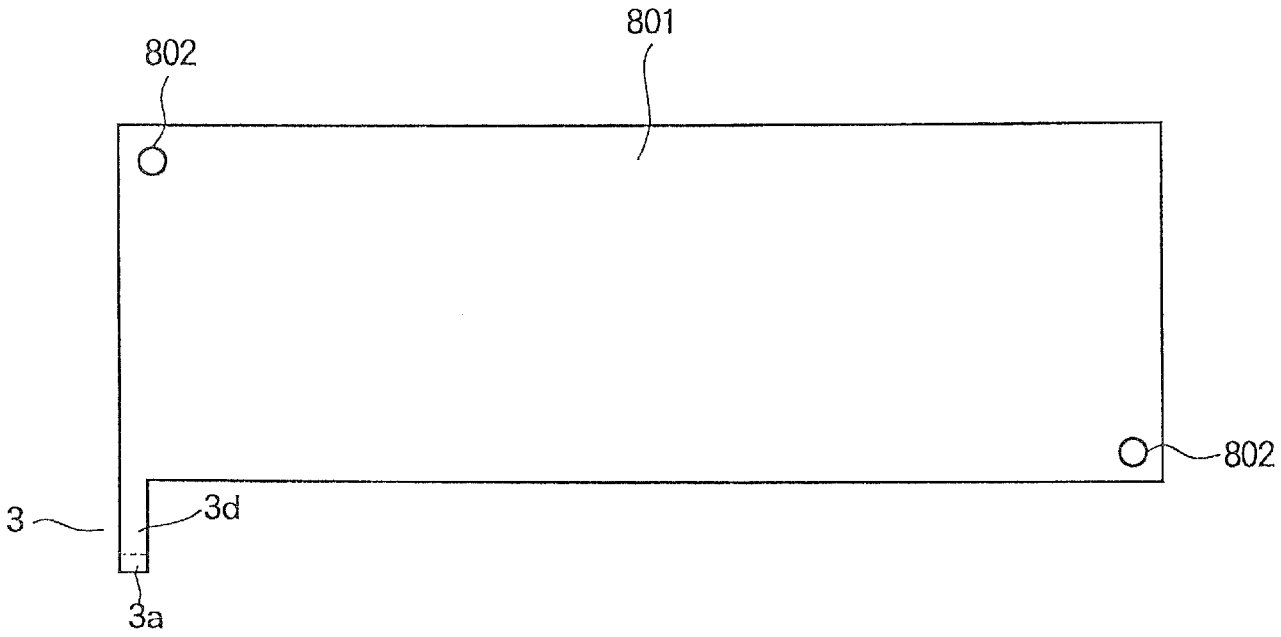
FIG. 9 is a perspective view showing a modification of the film according to the first embodiment.

Further, the film 3 (i.e., the resilient member) is not limited to a single member. For example, as shown in FIG. 9, the film 3 can be formed integrally with an insulation film 801 (i.e., an insulation member) for insulating the electronic circuit board 800 (FIG. 1) in the vicinity of the fan 700. The insulation film 801 is fixed to the frame 1 together with the electronic circuit board 800 using screws at the fixing holes 802. Since the film 3 is formed integrally with the insulation film 801, it becomes possible to prevent the operator from forgetting to mount the film 3 even when the film 3 is made small in size.

Although the fan 700 is used as an exhaust fan for exhausting the air from the image forming apparatus 10 in this embodiment, it is also possible to use the fan 700 as an intake fan for drawing air into the image forming apparatus 10.

Second Embodiment

Figure 10:
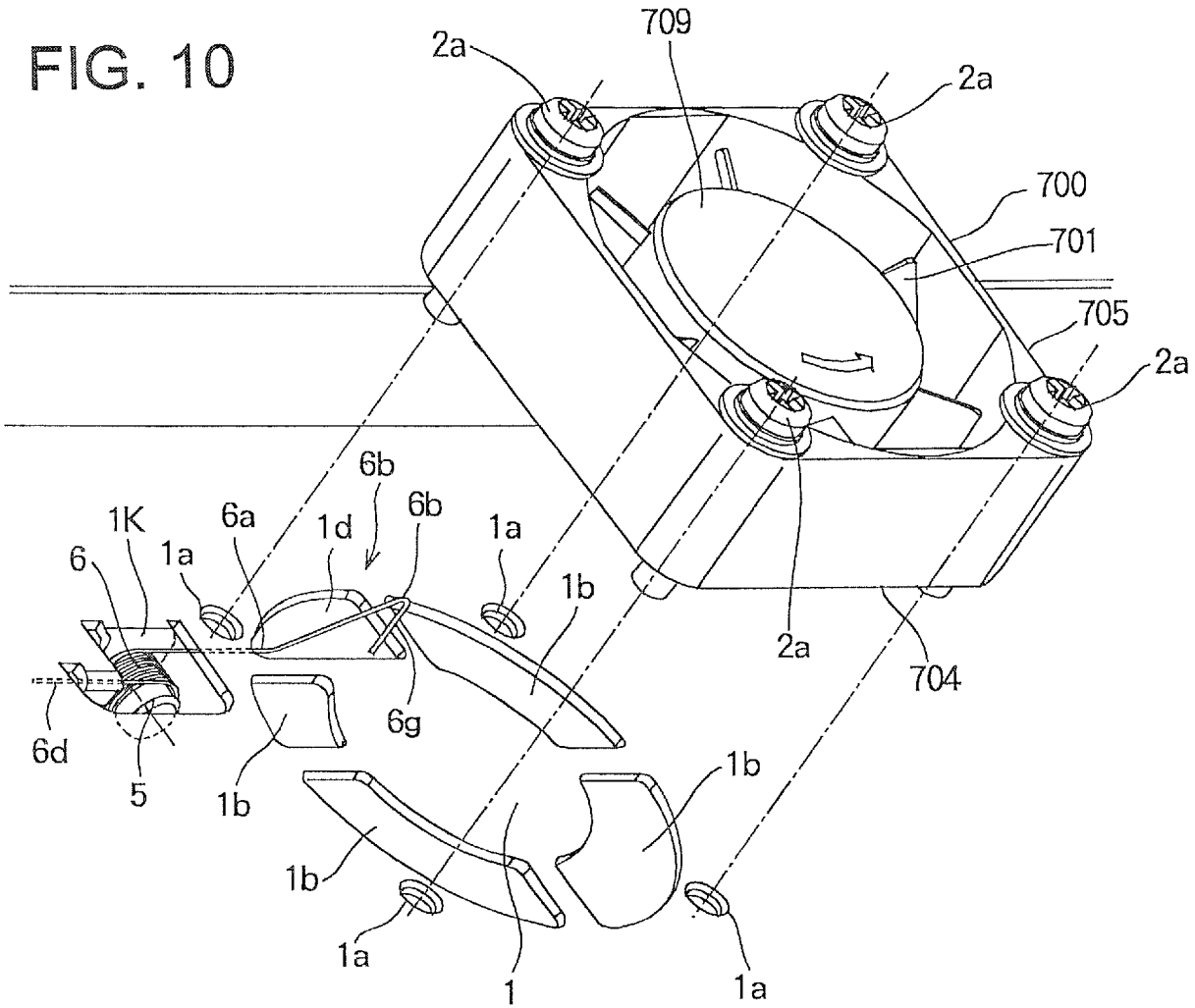
FIG. 10 is a perspective view showing a configuration of a fan and a frame according to the second embodiment of the present invention.

FIG. 10 is a perspective view showing a fan 700 and a frame 1 according to the second embodiment of the present invention. As described in the first embodiment, the fan 700 is mounted to the frame 1 (made of a sheet metal) by screwing the screws 2*a* into the internal threads 1*a* of the frame 1. The frame 1 has the exhaust openings 1*b* described in the first embodiment.

In the second embodiment, the film 3 of the first embodiment is replaced by a spring 6 mounted to the frame 1. To be more specific, a part (referred to a cut-and-raised portion 1*k*) of the frame 1 is cut and raised in a direction away from the fan 700 (i.e., toward the back surface if side shown in FIG. 4B). A post 5 is provided on the cut-and-raised portion 1*k*. The post 5 has an axial direction parallel to the frame 1. The spring 6 is provided around the post 5. The spring 6 is made of, for example, a metal.

Figure 11:
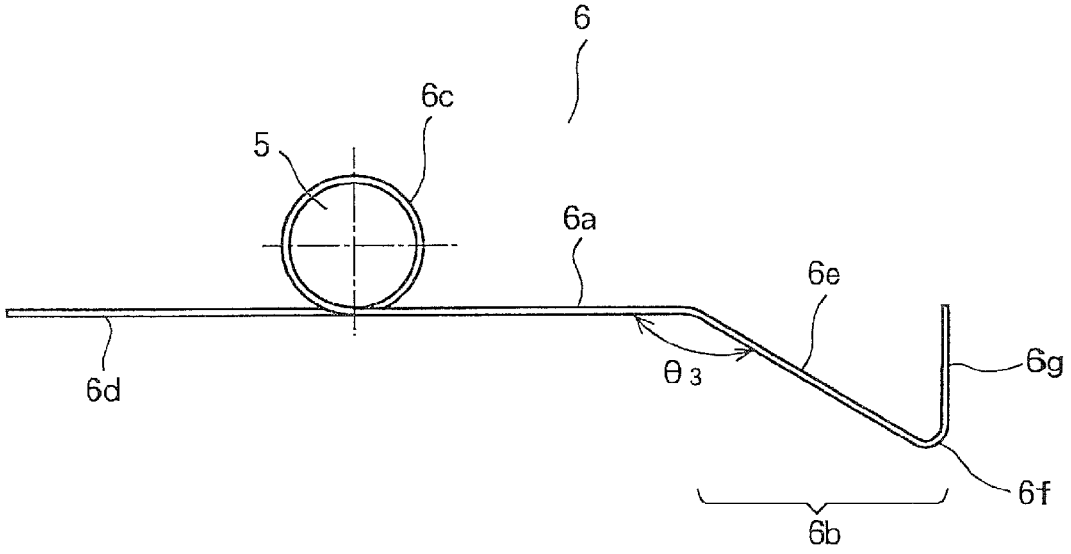
FIG. 11 is a side view showing a shape of a spring according to the second embodiment.

FIG. 11 is a side view showing a shape of the spring 6. The spring 6 is made of a torsion coil spring. The spring 6 includes a coil portion 6*c* (i.e., a fixed portion) where a spring wire is wound in a spiral form, and a pair of arm portions 6*a* and 6*d* (i.e., base portions) extending linearly from both ends of the coil portion 6*c*. The coil portion 6*c* of the spring 6 is mounted to an outer circumference of the post 5 (FIG. 10) provided on the frame 1.

The arm portion 6*d* of the spring 6 contacts the back surface 1*f* (FIG. 4B) of the frame 1 opposite to the fan 700. The arm portion 6*a* of the spring 6 extends a predetermined length along the frame 1, is bent toward the fan 700 (i.e., downward in FIG. 11), and obliquely extends a predetermined length. The obliquely extending portion of the spring 6 is referred to as a slope portion 6*e*. An upright portion 6*g* extends toward the frame 1 (i.e., upward in FIG. 11) from an end of the slope portion 6*e*. A rounded portion 6*f* is formed between the slope portion 6*e* and the upright portion 6*g*.

The slope portion 6*e* and the rounded portion 6*f* constitute a bent portion 6*b* (i.e., a protruding portion or a free end portion). The bent portion 6*b* protrudes toward the fan 700 through the opening 1*d* (FIG. 10).

Figure 12:
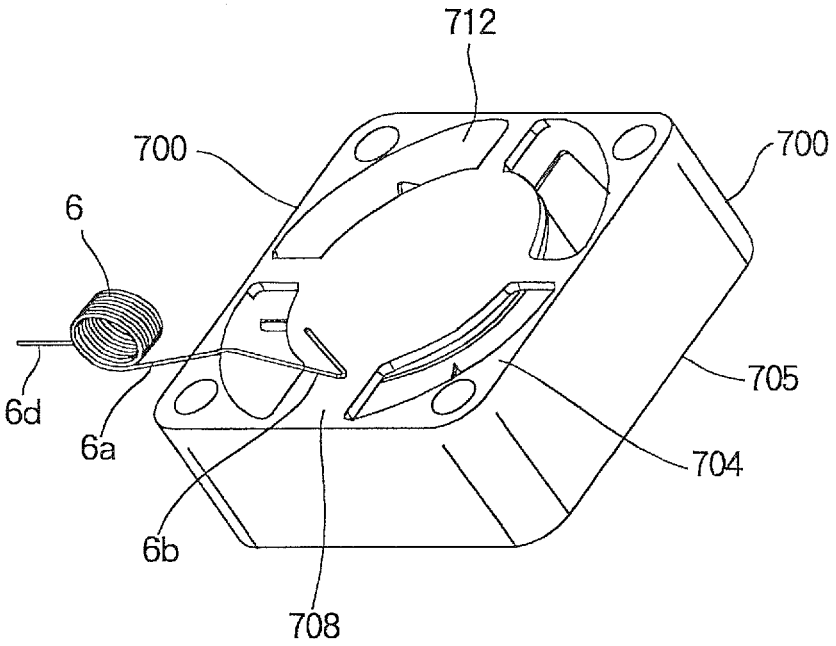
FIG. 12 is a perspective view showing a state where the fan is mounted to the frame in the correct orientation.

FIG. 12 is a perspective view showing the fan 700 mounted to the frame 1 in the correct orientation. When the fan 700 is mounted to the frame 1 in the correct orientation, the bent portion 6*b* of the spring 6 contacts the rib 708 of the fan 700 and deforms. Therefore, the bent portion 6*b* of the spring 6 does not enter inside the fan 700. That is, the bent portion 6*b* of the spring 6 does not interfere with the rotation of the impeller 701. Accordingly, the impeller 701 of the fan 700 normally rotates.

Figure 13B:
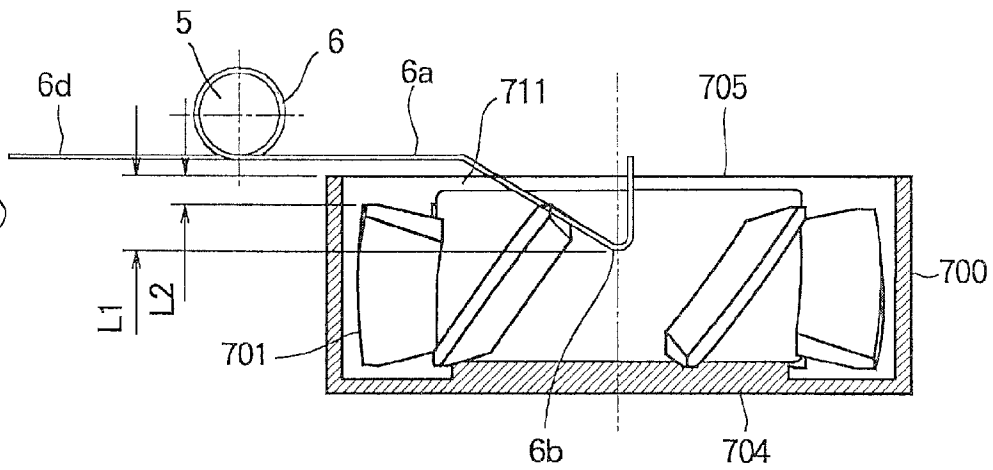
FIGS. 13A and 13B are respectively a perspective view and a sectional view showing a state where the fan is mounted to the frame in the opposite orientation according to the second embodiment.
Figure 13C:
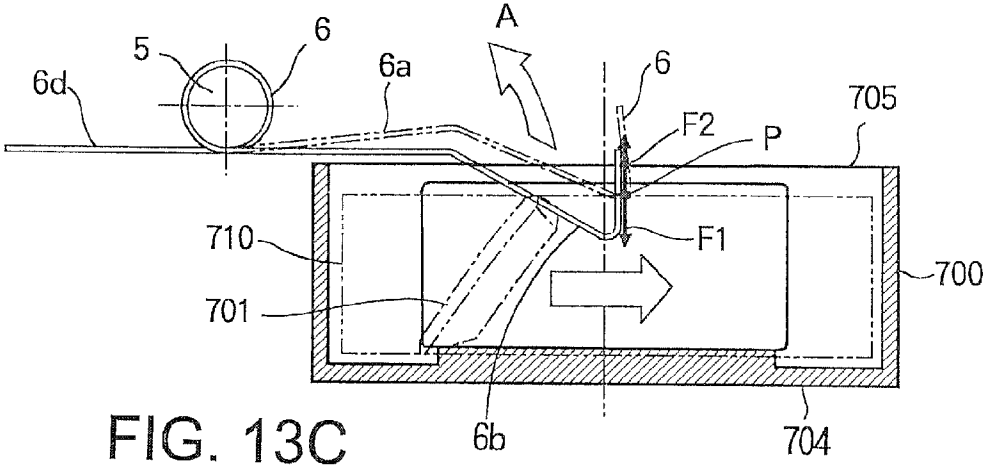
FIG. 13C is a sectional view showing a state where an impeller of the fan rotates when the fan is mounted to the frame in the opposite orientation according to the second embodiment.
Figure 13A:
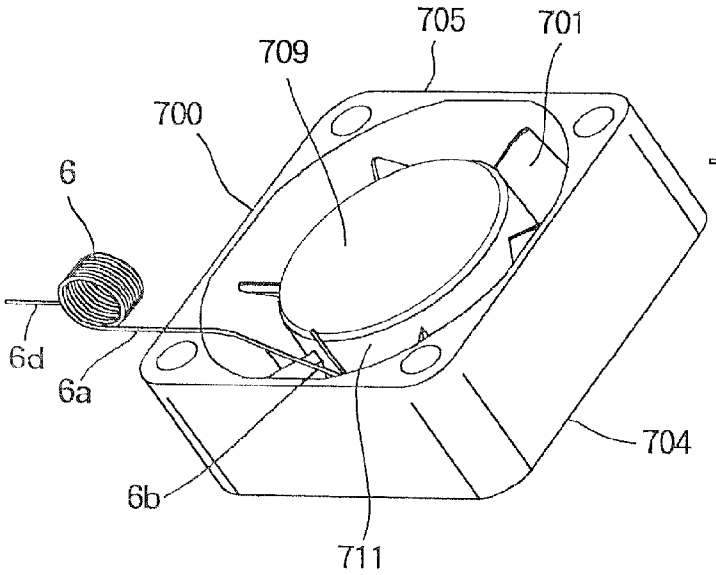

FIGS. 13A and 13B are respectively a perspective view and a sectional view showing a state where the fan 700 is mounted to the frame 1 in the opposite orientation. When the fan 700 is mounted to the frame 1 in the opposite orientation, the bent portion 6*b* of the spring 6 enters inside the fan 700 through the opening 711, and reaches the rotational area 710 of the impeller 701.

In FIG. 13B, a distance L1 from the intake side 705 of the fan 700 (fixed to the fan-fixing surface 1*e* when the fan 700 is mounted in the opposite orientation) to the tip (i.e., the rounded portion 6*f*) of the bent portion 6*b* of the spring 6 is larger than a distance L2 from the intake side 705 to the impeller 701 (L1>L2). This means that the bent portion 6*b* of the spring 6 reaches the rotational area 710 of the impeller 701.

If the motor 702 starts rotating in a state where the bent portion 6*b* of the spring 6 reaches the rotational area 710 of the impeller 701, the impeller 701 flips up the bent portion 6*b* of the spring 6 to cause the bent portion 6*b* to deform as shown in FIG. 13C.

As shown in FIG. 13C, in the rotational area 710 of the impeller 701, a contact point where the bent portion 6*b* of the spring 6 contacts the impeller 701 is expressed as P. A counterforce with which the spring 6 pushes the impeller 701 at the contact point P is expressed as F1. A force with which the impeller 701 (driven by the motor 702) pushes up the spring 6 at the contact point P is expressed as F2. The forces F1 and F2 satisfy the relationship F1<F2.

With such a configuration, the bent portion 6*b* of the spring 6 flipped up by the impeller 701 repeatedly contacts the impeller 701 to generate a noise. This noise informs the operator of that the fan 700 is mounted to the frame 1 in the opposite orientation.

A rotation number (i.e., a rotation speed) of the impeller 701 is reduced by application of the counterforce when the impeller 701 contacts the bent portion 6*b* of the spring 6. Therefore, the sensor 901 (i.e., the detection unit) as shown in FIG. 1 is provided for detecting the rotation number of the impeller 701. The control unit (i.e., the electronic circuit board) 800 detects the decrease in the rotation number based on a detection result of the sensor 901.

In a particular example, when the control unit 800 determines that the rotation number of the impeller 701 decreases, the control unit 800 causes the display unit 902 (FIG. 2) of the image forming apparatus 10 to display a message to draw attention of an operator. The message indicates that the rotation of the fan 700 is abnormal, or that the rotation number of the fan 700 decreases.

An angle θ3 between the bent portion 6*b* (i.e., the slope portion 6*e* and the rounded portion 6*f*) and the arm portion 6*a* of the spring 6 is an obtuse angle. Therefore, when the bent portion 6*b* of the spring 6 starts contacting the impeller 701, a counterforce applied to the impeller 701 by the spring 6 in a direction to resist the rotation of the impeller 701 (i.e., a force with which the bent portion 6*b* of the spring 6 pushes the impeller 701) is small. The counterforce of the spring 6 gradually increases as the spring 6 deforms in the direction away from the impeller 701. Therefore, a load applied to the fan 700 due to the contact between the impeller 701 and the bent portion 6*b* of the spring 63 can be reduced.

In this embodiment, the force F1 (FIG. 6C) with which the spring 6 pushes the impeller 701 is smaller than the force F2 with which the impeller 701 pushes up the spring 6 (F1<F2). However, this embodiment is not limited to such a configuration, but the force F1 can be larger than the force F2 (F1>F2). In this case, the rotation of the impeller 701 is stopped by the contact between the bent portion 6*b* of the spring 6 and the impeller 701. Therefore, for example, the electronic circuit board (the control unit) 800 can be configured to detect the stopping of the rotation of the impeller 701 using the sensor 901, and to cause the display unit 902 to display a massage to draw attention of the operator.

It is only necessary that the spring 6 achieves the function described with reference to FIGS. 13A through 13C using resiliency. For example, the spring 6 can be composed of a plate spring, a wire rod spring, or a combination thereof.

An entire configuration and operation of the image forming apparatus 10 of the second embodiment are the same as those of the first embodiment, and therefore description thereof will be omitted.

If the fan 700 is mounted to the frame 1 in the opposite orientation (i.e., if the fan 700 is incorrectly mounted to the frame 1) in an assembling process of the image forming apparatus 10, such an incorrect mounting can be detected during a test operation before the image forming apparatus 10 is shipped. That is, when the motor 702 of the fan 700 starts rotation, the impeller 701 flips up the bent portion 6*b* of the spring 6 to generate a noise. Thanks to the noise, the operator can recognize that the fan 700 is incorrectly mounted to the frame 1. Accordingly, the operator can dismount the fan 700 from the frame 1, and then mount the fan 700 to the frame 1 in the correct orientation.

In addition to the advantages described in the first embodiment, the second embodiment provides the advantages described below.

If the film 3 of the first embodiment is kept being pushed by the rib 708 of the fan 700 (i.e., kept being deformed as shown in FIG. 6C) for a long time period, the film 3 may be subjected to plastic deformation due to creep deformation depending on a material of the film 3. In such a case, when the fan 700 is to be replaced with a new one in maintenance or the like (after a long time use of the image forming apparatus 10), there is a possibility that the film 3 may not recover its original shape. Therefore, there is a possibility that the film 3 no longer perform the function to detect the incorrect mounting of the fan 700.

In contrast, according to the second embodiment, the spring 6 (more specifically, the torsion coil spring) is made of a metal resilient member, and is not likely to be subjected to plastic deformation. Therefore, when the fan 700 is to be replaced with new one in maintenance or the like, the spring 6 can perform function to detect the incorrect mounting of the fan 700.

In the above described embodiments, the image forming apparatus has been described as an example of the information processing apparatus. However, the present invention is applicable to any kind of information processing apparatus having a fan and a subject to be cooled.

Further, in the above described embodiments, an electrophotographic printer has been described as an example of the image forming apparatus. However, the present invention is also applicable to an ink-jet type image forming apparatus. Moreover, the present invention is also applicable to a facsimile machine, a copier, a multifunction peripheral or the like.

While the preferred embodiments of the present invention have been illustrated in detail, it should be apparent that modifications and improvements may be made to the invention without departing from the spirit and scope of the invention as described in the following claims.

What is claimed is:

1. An information processing apparatus comprising:

a fan having a rotation shaft and an impeller provided on an outer circumference of the rotation shaft, the fan further having a first side and a second side opposite to each other;

a frame to which the fan is mounted in a predetermined orientation so that the first side of the fan faces the frame, the frame having a ventilation opening facing the impeller; and a resilient member provided on the frame so as to face the fan, the resilient member having a fixed end portion and a free end portion extending from the fixed end portion, the free end portion being displaceable in a direction of the rotation shaft, wherein the fan has a supporting portion on the first side, and an opening on the second side, the supporting portion facing the resilient member;

wherein in a state where the fan is mounted to the frame in a direction opposite to the predetermined direction, the free end portion reaches a rotational area of the impeller via the opening; and wherein in a state where the fan is mounted to the frame in the predetermined direction, the supporting portion contacts the free end portion of the resilient member to cause the resilient member to resiliently deform, and prevents the resilient member from reaching the rotational area of the impeller.

2. The information processing apparatus according to claim 1, wherein the resilient member has a cantilever shape, wherein the resilient member has the fixed end portion fixed to the frame and a protruding portion that protrudes toward the rotational area of the impeller.

3. The information processing apparatus according to claim 2, wherein the resilient member has a base portion, and wherein an obtuse angle is formed between the base portion of the resilient member and the protruding portion.

4. The information processing apparatus according to claim 1, further comprising:

a control unit that controls an operation of the fan;

a detection unit that detects a rotational condition of the impeller, and a display unit that displays information on a condition of the fan, wherein the control unit causes the display unit to display predetermined information when the control unit detects a decrease in a rotation speed of the impeller based on a detection result of the detection unit.

5. The information processing apparatus according to claim 1, further comprising:

a control unit that controls an operation of the fan;

a detection unit that detects a rotational condition of the impeller, and a display unit that displays information on a condition of the fan, wherein the control unit causes the display unit to display predetermined information when the control unit detects a stopping of the impeller based on a detection result of the detection unit.

6. The information processing apparatus according to claim 1, wherein the resilient member is in the form of a torsion coil spring.

7. The information processing apparatus according to claim 1, wherein the resilient member is mounted to the frame in such a manner that the resilient member is displaceable in a direction away from the fan.

8. The information processing apparatus according to claim 7, wherein the resilient member is mounted to a side of the frame opposite to the fan, and wherein a part of the resilient member protrudes toward the fan via an opening formed on the frame.

9. An image forming apparatus comprising the information processing apparatus according to claim 1.

10. An information processing apparatus comprising:

a fan having an impeller, the fan further having a first side and a second side opposite to each other;

a frame to which the fan is mounted in a predetermined orientation so that the first side of the fan faces the frame, the frame having a ventilation opening facing the impeller;

a resilient member provided on the frame so as to face the fan;

an electronic circuit board provided in the vicinity of the fan; and an insulation member provided for insulation of the electronic circuit board, wherein the fan has a supporting member on the first side, and an opening on the second side, the supporting member facing the resilient member; and wherein the resilient member is provided on the insulation member.

11. An information processing apparatus comprising:

a fan having an impeller, the fan further having a first side and a second side opposite to each other;

a frame to which the fan is mounted in a predetermined orientation so that the first side of the fan faces the frame, the frame having a ventilation opening facing the impeller; and a resilient member provided on the frame so as to face the fan, wherein the fan has a supporting member on the first side, and an opening on the second side, the supporting member facing the resilient member; and wherein the resilient member is in the form of a film.

12. The information processing apparatus according to claim 11, wherein the resilient member includes:

a fixed end portion;

a base portion extending from the fixed end portion; and a protruding portion that protrudes from an end of the base portion opposite to the fixed end portion toward a rotational area of the impeller.

13. The information processing apparatus according to claim 12, wherein an obtuse angle is formed between the base portion and the protruding portion.

14. The information processing apparatus according to claim 12, wherein the fixed end portion, the base portion and the protruding portion constitute a part of an insulation member.

15. The information processing apparatus according to claim 14, wherein the insulation member is provided for insulation of an electronic circuit board.

* * * * *